US012723752B2

(12) United States Patent
Lin et al.

(10) Patent No.: US 12,723,752 B2
(45) Date of Patent: Sep. 1, 2026

(54) ENERGY-SAVING ASSEMBLY FOR INDIRECT HEATING SYSTEMS

(71) Applicant: INDUSTRIAL TECHNOLOGY RESEARCH INSTITUTE, Hsinchu (TW)

(72) Inventors: Yi-Hsing Lin, Tainan (TW); Chung-Wei Fu, Hsinchu County (TW); Yu-Lun Lai, Tainan (TW); Cheng-Hsien Shen, Tainan (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 396 days.

(21) Appl. No.: 18/539,496

(22) Filed: Dec. 14, 2023

(65) Prior Publication Data

US 2025/0172290 A1 May 29, 2025

(30) Foreign Application Priority Data

Nov. 23, 2023 (TW) ..... 112145423

(51) Int. Cl.
*F23D 14/16* (2006.01)
*F23C 3/00* (2006.01)

(52) U.S. Cl.
CPC ..... *F23D 14/16* (2013.01); *F23C 3/002* (2013.01)

(58) Field of Classification Search
CPC ..... F23D 14/16; F23C 3/002
See application file for complete search history.

(56) References Cited

U.S. PATENT DOCUMENTS

| | | | |
|---|---|---|---|
| 3,920,383 | A | 11/1975 | Kerr |
| 6,484,795 | B1 | 11/2002 | Kasprzyk |
| 8,162,040 | B2 | 4/2012 | Briselden |
| 10,030,867 | B2 | 7/2018 | Nicolia et al. |
| 11,022,301 | B2 | 6/2021 | Jones |
| 2007/0224565 | A1 | 9/2007 | Briselden |
| 2009/0277969 | A1 | 11/2009 | Briselden |
| 2015/0079529 | A1 | 3/2015 | Nicolia et al. |

FOREIGN PATENT DOCUMENTS

| | | | |
|---|---|---|---|
| CN | 2245759 | Y | 1/1997 |
| CN | 102095332 | A | 6/2011 |
| CN | 207112802 | U | 3/2018 |
| CN | 217424107 | U | 9/2022 |
| CN | 217541598 | U | 10/2022 |
| JP | S57112694 | A | 7/1982 |
| JP | 2017083127 | A | 5/2017 |

(Continued)

OTHER PUBLICATIONS

Taiwan Patent Office, "Office Action", Nov. 11, 2024, Taiwan.

(Continued)

*Primary Examiner* — Alfred Basichas
(74) *Attorney, Agent, or Firm* — troutman pepper locke; Tim Tingkang Xia, Esq.

(57) ABSTRACT

An energy-saving assembly for indirect heating systems includes a plurality of porous elements. Each porous element has a porous carrier which has multiple holes that go through the carrier. The porous carriers are arranged parallel to the axis of a radiant tube of the indirect heating system at a distance or adjacent and disposed of inside the radiant tube. The outer periphery of each porous element is at least partly adjacent to the inner wall of the radiant tube.

29 Claims, 13 Drawing Sheets

(56) References Cited

FOREIGN PATENT DOCUMENTS

| | | | |
|---|---|---|---|
| JP | 6437719 | B2 | 12/2018 |
| TW | M266974 | U | 6/2005 |
| TW | M350940 | U | 2/2009 |
| TW | M381776 | U | 6/2010 |
| TW | 201023971 | A | 7/2010 |
| TW | 201220588 | A | 5/2012 |
| TW | 201420188 | A | 6/2014 |
| TW | 201703582 | A | 1/2017 |
| TW | I727863 | B | 5/2021 |
| TW | 202421268 | A | 6/2024 |
| WO | 2015062619 | A1 | 5/2015 |
| WO | 2023034999 | A1 | 3/2023 |

OTHER PUBLICATIONS

B.A. Goeckner et al., Radiative heat transfer augmentation of natural gas flames in radiant tube burners with porous ceramic inserts, Experimental Thermal and Fluid Science, vol. 5, Issue 6, 1992, pp. 848-860.

Hai Wu et al., Furnace combustion and control renovation to improve the productivity of a continuous annealing line, Energy Procedia, vol. 120, 2017, pp. 454-461.

Taiwan Patent Office, “Notice of Allowance” Jun. 27, 2025, Taiwan.

ENERGY-SAVING ASSEMBLY FOR INDIRECT HEATING SYSTEMS

CROSS REFERENCE TO RELATED APPLICATION

This application claims the benefits of Taiwan application Serial No. 112145423, filed on Nov. 23, 2023, the disclosures of which are incorporated by references herein in its entirety.

TECHNICAL FIELD

The present disclosure relates in general to a heating technology, and more particularly to an energy-saving assembly disposed inside a radiant tube of an indirect heating system.

BACKGROUND

In the field of heavy industries, such as the steel industry, radiant tubes are used to process products by indirect heating. Generally, a typical operating temperature in the radiant tube is approximately between 700 and 1,000° C.

Since the heated smoke or flue gas is directly discharged without any recycling for reuse, thus a process heat loss usually accounts for about 44%, of which the heat loss from the smoke accounts for more than 25%.

In order to resolve the problem of heat loss, currently a method of using silicon carbide (SiC) inserts is popular. With structural turbulence of the smoke promotes convective heat transfer in the radiant tube, thereby the tube-wall temperature can be increased by approximately 5 to 30° C. higher so as to promote the energy saving rate. However, the above-mentioned conventional plug-in method does not have a function of catalyzing the smoke.

In addition, currently known plug-in tools in the marketplace are expensive in price and poor in tolerance, and usually suffer from carbon deposits and other problems that still require further technical optimization.

Accordingly, how to develop an "energy-saving assembly for indirect heating systems" that can catalyze the residual methane and carbon monoxide in the smoke to release heat, guide the smoke, and increase the turbulence is definitely urgent issue for people in the relevant technical field to solve.

SUMMARY

In one embodiment of this disclosure, an energy-saving assembly for indirect heating systems comprises:

a plurality of porous elements, each of the plurality of porous elements having a porous carrier, the porous carrier having a plurality of holes penetrating individually the porous carrier, an axis of the porous carrier parallel to a radiant tube being separately or close to each other disposed in the radiant tube of one of the indirect heating systems, an outer periphery of one of the plurality of porous elements and an inner wall of the radiant tube being at least partly adhered to each other.

In another embodiment of this disclosure, an energy-saving assembly for indirect heating systems comprises:

a plurality of porous elements, each of the plurality of porous elements having a porous carrier, the porous carrier having a plurality of holes penetrating individually the porous carrier, an axis of the porous carrier parallel to a radiant tube being separately or close to each other disposed in the radiant tube of one of the indirect heating systems, an outer periphery of one of the plurality of porous elements and an inner wall of the radiant tube being at least partly adhered to each other; and a plurality of spiral elements, each of the plurality of spiral elements having a spiral carrier, the spiral carrier being a coil structure having a plurality of pitched spirals continuously connected, extending along and surrounding an axis, the plurality of spiral elements being separately or close to each other disposed in the radiant tube by being parallel to the axis of the radiant tube, an outer periphery of each of the plurality of spiral elements and the inner wall of the radiant tube being at least partly adhered to each other, an outer diameter of each of the plurality of porous elements being less than or equal to another outer diameter of each of the plurality of spiral elements.

In a further embodiment of this disclosure, an energy-saving assembly for indirect heating systems comprises:

a plurality of porous elements, separately arranged in a radiant tube of an indirect heating system by being parallel to an axis of a radiant tube of indirect heating system, each of the plurality of porous elements having a porous carrier, the porous carrier having a plurality of holes penetrating through the porous carrier, the porous carrier being coated by an oxidation catalyst having a chemical formula of $Cu_{1-x}M_xO_y$, the M being a Ce or an Mn, the x being within 0.1 to 0.9, the y being a valence number corresponding to the Cu and the M, the oxidation catalyst having a middle hole and a mega hole, the middle hole having a dimension within 10 nm to 50 nm, the mega hole having a dimension within 100 nm to 400 nm.

In one more embodiment of this disclosure, an energy-saving assembly for indirect heating systems comprises:

a plurality of porous elements, separately arranged in a radiant tube of an indirect heating system by being parallel to an axis of a radiant tube of indirect heating system, each of the plurality of porous elements having a porous carrier, the porous carrier having a plurality of holes penetrating through the porous carrier, the porous carrier being coated by an oxidation catalyst having a chemical formula of $Cu_{1-x}M_xO_y$, the M being a Ce or an Mn, the x being within 0.1 to 0.9, the y being a valence number corresponding to the Cu and the M, the oxidation catalyst having a middle hole and a mega hole, the middle hole having a dimension within 10 nm to 50 nm, the mega hole having a dimension within 100 nm to 400 nm; and a plurality of spiral elements, each of the plurality of spiral elements having a spiral carrier, the spiral carrier being a coil structure having a plurality of pitched spirals surrounding an axis, the spiral carrier being coated by an oxidation catalyst.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
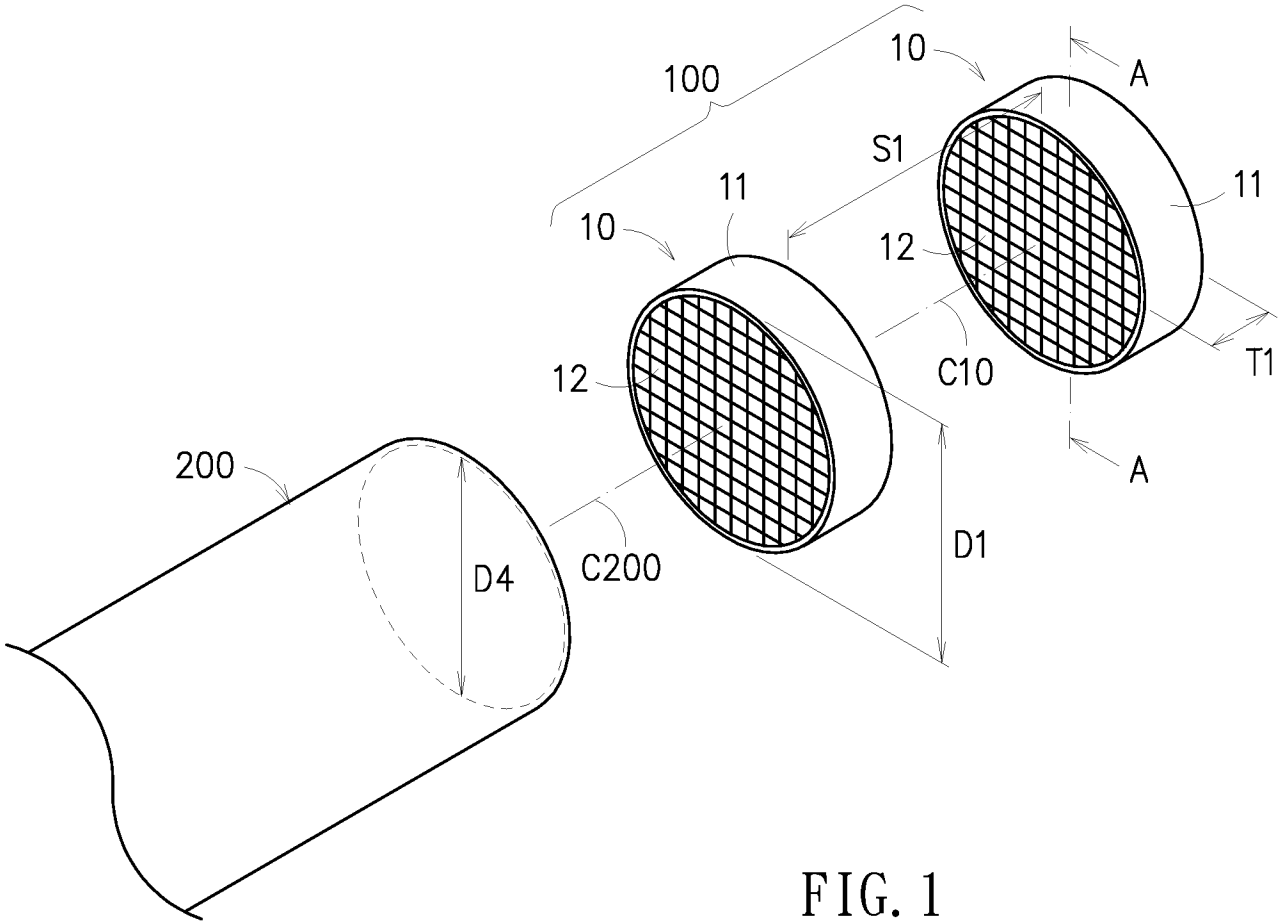
FIG. 1 is a schematic view of an embodiment of the indirect heating system in accordance with this disclosure pairing a radiant tube.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Referring to FIG. 1, an energy-saving assembly for indirect heating systems 100 includes two porous elements 10. These two porous elements 10 are both parallel to an axis C200 of a radiant tube 200 of an indirect heating system, and separately arranged inside the radiant tube 200. These two porous elements 10 are separated by a spacing S1.

Each of the porous elements 10 has a porous carrier 11, and the porous carrier 11 has a plurality of holes 12 penetrating through the porous carrier 11.

As shown in FIG. 1, the porous element 10 can be cylindrical. The axis C10 of the porous elements 10 is parallel to the axis C200 of the radiant tube 200 of the indirect heating system, these two porous elements 10 are separately arranged inside the radiant tube 200, and the axis C200 of the radiant tube 200 of the indirect heating system is disposed in the radiant tube 200. The axis C10 and the axis C200 can be or cannot be coaxial. Each of the holes 12 is parallel to the axis C10 and the porous carrier 11.

According to this disclosure, the number of the porous elements 10 may not be limited to two shown in FIG. 1, but may be determined per practical requirements.

Further, the shape of the porous element 10 is not limited to the aforesaid cylinder shown in FIG. 1, but arbitrary shapes, such as rectangle, triangle, arbitrary polygon, arbitrary regular polygon or irregular shapes. Since the radiant tube 200 presents a round tube shape, thus this disclosure have the cylindrical porous element 10 as an example for explanation.

The holes 12 of the porous element 10 are not limited to the aforesaid rectangles shown in FIG. 1, but arbitrary shapes such as a combination of honeycomb, circle, triangle, arbitrary polygon, arbitrary regular polygon and irregular shapes.

The porous carrier 11 is made of a material with a withstandable temperature within 700~1,220° C., such as ceramics, for withstanding the operating temperature of the radiant tube 200.

The specifications of the porous element 10 are designed according to practical needs. For example, the porous element 10 may have 25~50 holes 12 per square inch of cross section thereof. The porous element 10 is parallel to the axis C200 of the radiant tube 200 (i.e., the direction parallel to the axis C10 of the porous elements 10), and has a first thickness T1 within 50 mm~100 mm.

Preferably, the porous element 10 shall have an outer diameter D1 less than an inner diameter D4 of the radiant tube 200, such that the porous elements 10 can be easily placed into the radiant tube 200.

For example, as the outer diameter D1 of the porous elements 10 is 135 mm, the inner diameter D4 of the radiant tube 200 can be 0145 mm; as the outer diameter D1 of the porous element 10 is 150 mm, the inner diameter D4 of the radiant tube 200 can be 184 mm, 162 mm or 175 mm. Namely, a ratio of the outer diameter D1 of the porous element 10 to the inner diameter D4 of the radiant tube 200, D1/D4, shall be within 0.82~0.93.

Per practical needs, the porous carrier 11 can be coated with an oxidation catalyst, such as an oxidation catalyst having a chemical formula of $Cu_{1-x}M_xO_y$, in which the M is a Ce or an Mn, the x is within 0.1 to 0.9, and the y is a valence number corresponding to the Cu and the M. This oxidation catalyst has at least a middle hole and a mega hole, the middle hole has a dimension within 10 nm to 50 nm, the mega hole has a dimension within 100 nm to 400 nm.

It is worthy o note that the aforesaid oxidation catalyst is provided by applicant of this disclosure in a previous Taiwan patent application filed on Nov. 17, 2022. The oxidation catalyst is an oxidation catalyst that is resistant to high temperatures and is used in the heat release of methane ($CH_4$) combustion. It is suitable for oxygen-poor high-temperature operating environments and can convert methane, a carbon oxide, or a combination in smoke of the above into $CO_2$ and water, such that the smoke temperature can be increased, and large quantities thereof can be quickly prepared to reduce costs.

Figure 2A:
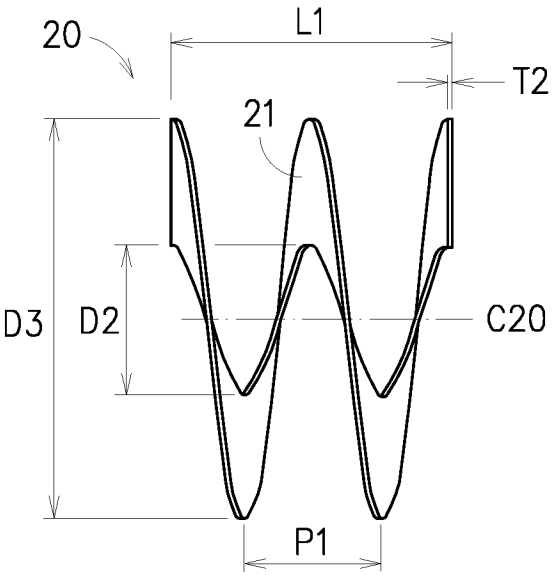
FIG. 2A is a schematic radial side view of the spiral element of FIG. 2.
Figure 2:
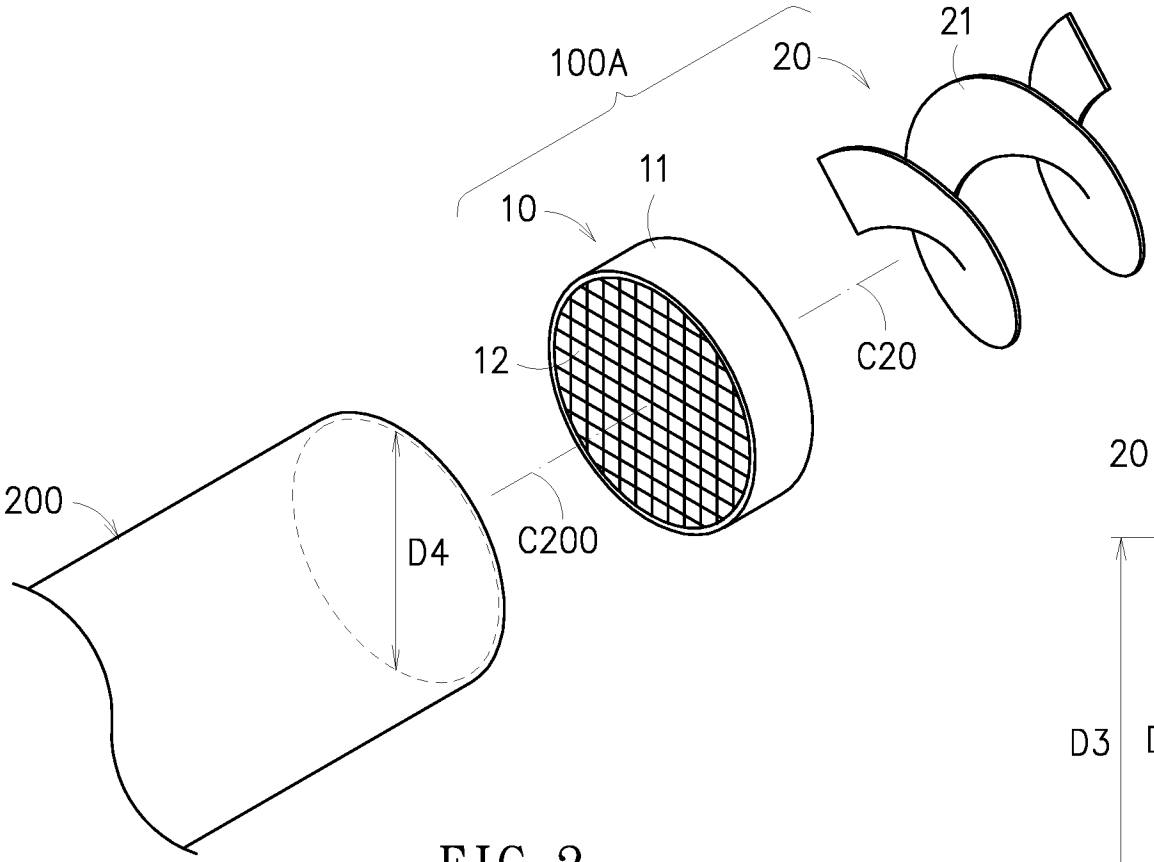
FIG. 2 is a schematic view of another embodiment of the indirect heating system in accordance with this disclosure pairing the radiant tube.

Referring to the embodiment shown in FIG. 2 And FIG. 2A, an energy-saving assembly for indirect heating systems 100A includes two porous elements 10 and a spiral element 20.

Structuring of the porous elements 10 in FIG. 2 and those in FIG. 1 are identical, and thus detail thereabout would be omitted herein.

The spiral element 20 has a spiral carrier 21. The spiral carrier 21 is a coil structure having a plurality of pitched spirals and surrounding an axis C20.

The axis C20 of the spiral element 20 is parallel to the axis C200 of the radiant tube 200, and the spiral element 20 is disposed inside the radiant tube 200. The axis C10 of the porous elements 10 and the axis C200 of the spiral element 20 can be or cannot be co-axial.

According to this disclosure, the number of the porous elements 10 may not be limited to two shown in FIG. 2, and also the number of the spiral elements 10 may not be limited to one shown in FIG. 2, but may be determined per practical requirements.

The spiral carrier 21 is made of a material with a withstandable temperature within 700~1,220° C., such as ceramics or alloys, for withstanding the operating temperature of the radiant tube 200.

The specifications of the spiral element 20 are designed according to practical needs. For example, the spiral element 20 may have a second thickness T2 within 5 mm~10 mm. The inner diameter D2 of the spiral carrier 21 is within 20 mm to 50 mm, and the outer diameter D3 thereof is within 135 mm to 150 mm. Namely, a ratio of the inner diameter D2 of the spiral carrier 21 to the outer diameter D3 of the spiral carrier 21, D2/D3, shall be within 0.33~0.37.

The outer diameter D3 of the spiral element 20 (i.e., the outer diameter D3 of the spiral carrier 21) is less than the inner diameter D4 of the radiant tube 200. For example, as the outer diameter D3 of the spiral element 20 is 135 mm, the inner diameter D4 of the radiant tube 200 can be 145 mm; and, as the outer diameter D3 of the spiral element 20 is 150 mm, the inner diameter D4 of the radiant tube 200 can be 184 mm, 162 mm or 175 mm. Namely, a ratio of the outer diameter D3 of the spiral element 20 to the inner diameter D4 of the radiant tube 200, D3/D4, shall be within 0.82~0.93.

Referring to FIG. 1 and FIG. 2A, regarding a relative dimension ratio of the porous element 10 to the spiral element 20, the outer diameter D1 of the porous element 10 is less than or equal to the outer diameter D3 of the spiral element 20 of FIG. 2A (noted that the D1/D3 is within 0.9~1.0). For example, as the outer diameter D3 of the spiral element 20 is 135 mm, the outer diameter D1 of the porous element 10 would be 121.5~135 mm; or, as the outer diameter D3 of the spiral element 20 is 150 mm, the outer diameter D1 of the porous element 10 would be 135~150 mm.

The spiral element 20 has a plurality of pitched spirals connected continuously to form a coil-like spiral structure, and an axial distance of any two neighboring circling of the coil-like structure defines the height of the pitched spiral and also a pitch P1. The spiral element 20 has an axial height L1 parallel to the axis C20. A ratio of the axial length L1 to the pitch P1, L1/P1, is within 1.5~2. For example, the pitch P1 may be within 50~150 mm. If the pitch P1 is 50 mm, then the axial length L1 would be within 75~100 mm; or, if the pitch P1 is 100 mm, then the axial length L1 would be 150~200 mm.

Per practical requirements, the spiral carrier 21 can be coated by an oxidation catalyst. For example, the oxidation catalyst coated on the spiral carrier 21 can be the same one coated on the porous carrier 11 of the porous element 10, such that the same surface performance can be obtained.

Figure 3:
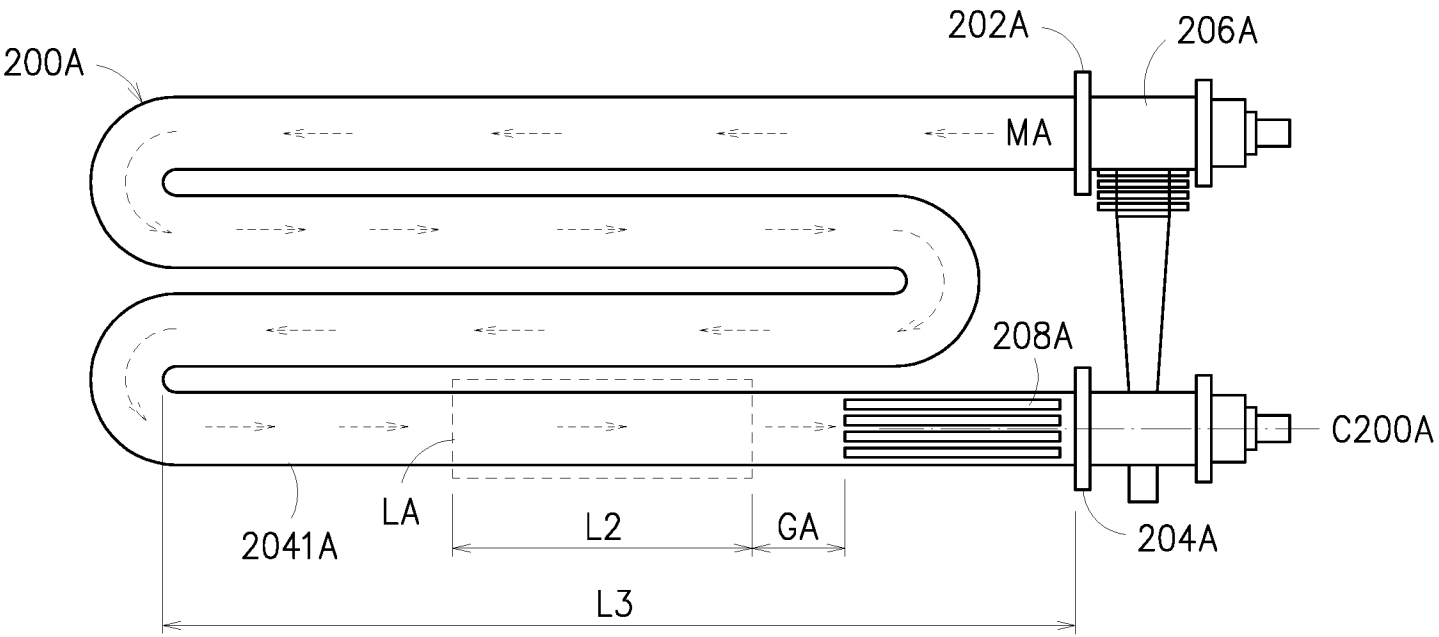
FIG. 3 (Prior art)
FIG. 3 and FIG. 4 show schematically two conventional radiant tubes in the art.

Refer to a radiant tube 200A shown in FIG. 3, where a continuous radiant tube with multiple bents is shown. Two opposite ends of the radiant tube 200A are formed as an inlet 202A and an outlet 204A, respectively. The inlet 202A is furnished with a burner 206A, and a reheater 208A is provided inside the radiant tube 200A at a portion close to the outlet 204A.

Figure 4:
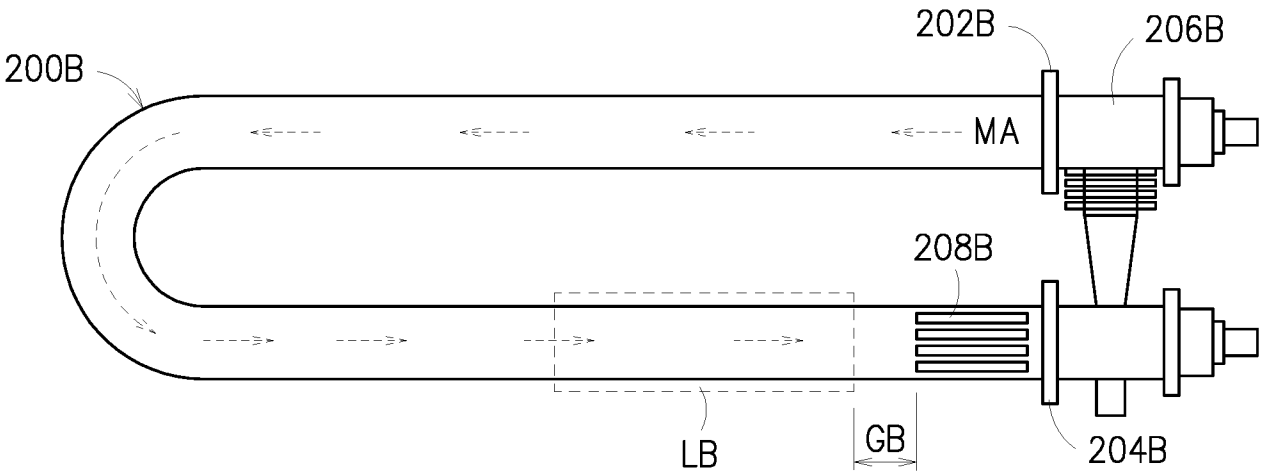
FIG. 4 (Prior art)

Refer to a radiant tube 200B shown in FIG. 4, where a continuous radiant tube extended as a U shape tube is shown. Two opposite ends of the radiant tube 200B are formed as an inlet 202B and an outlet 204B, respectively. The inlet 202B is furnished with a burner 206B, and a reheater 208B is provided inside the radiant tube 200B at a portion close to the outlet 204B.

Though configurations of the two conventional radiant tubes 200A, 200B in FIG. 3 and FIG. 4 are different, yet the operation methods are the same. In any of the radiant tubes 200A, 200B, a burning smoke MA flows from the inlet 202A, 202B to the outlet 204A, 204B, as indicated by arrowed dashed lines.

In any of FIG. 1 and FIG. 2, the energy-saving assembly for indirect heating systems 100, 100A of this disclosure is installed inside the radiant tube 200A, 200B at a place preferably close to the outlet 204A, 204B, such as an installation scope LA, LB (blocked by a dashed box). For modifying the prior art, any of the energy-saving assemblies for indirect heating systems 100, 100A shown in FIG. 1, FIG. 2 can be installed into the installation scope LA, LB of FIG. 3, FIG. 4 at a place spaced from the reheater 208A, 208B by a distance GA, GB, respectively. According to this disclosure, determination of the distance GA, GB is up to practical needs.

Taking FIG. 3 as an example, the installation scope LA is located inside the radiant tube 200A at a straight tube 2041A close to the outlet 204A, where the installation scope LA has an axial length L2 along the axis C200A of the radiant tube 200A, and the straight tube 2041A has another axial length L3 along the axis C200A of the radiant tube 200A.

A ratio of the axial length L2 to the axial length L3, L2/L3, is within 0.45~0.51. For example, if the axial length L2 is 1000 mm, then the axial length L3 can be within 1,977~2,195 mm. Similarly, the foregoing ratio of the axial length L2 o the axial length L3 can be also applicable to the radiant tube 200B of FIG. 4.

Figure 5:
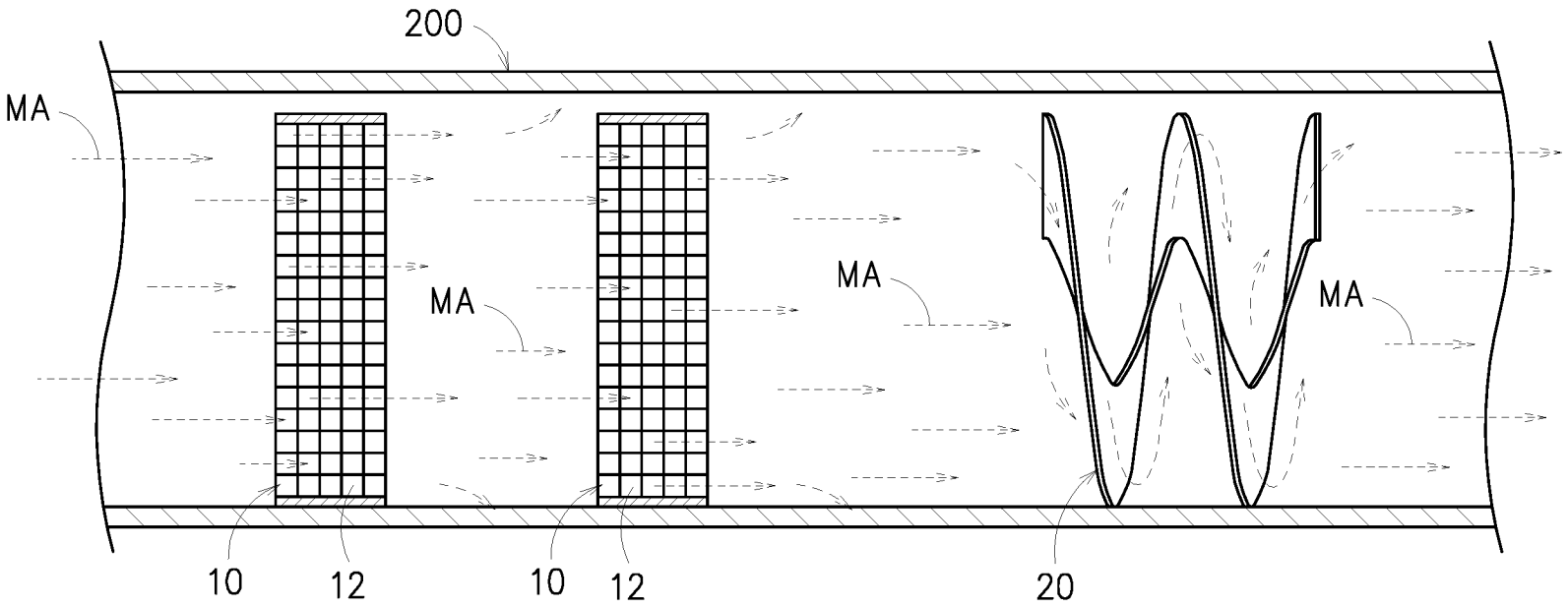
FIG. 5 is a schematic cross-sectional view of part of the radiant tube of FIG. 2.

Referring to FIG. 5, two said porous elements 10 and one said spiral element 20 are disposed into the radiant tube 200.

The porous elements 10 and the spiral element 20 can disturb the smoke MA, and also dissipate the heat energy of the smoke MA to the tube wall of the radiant tube 200.

After passing through the holes 12 of the porous elements 10 to the spiral element 20, the smoke MA will be led by the spiral design the radiant tube 200.

In addition, if the porous carrier 11 and the spiral carrier 21 are coated by the oxidation catalyst, then, while the smoke MA is passing the porous elements 10 or the spiral element 20, the coated oxidation catalyst on the porous elements 10 and the spiral element 20 would react with the smoke MA to further catalyze the unburned methane in smoke to release the heat energy.

Figure 6:
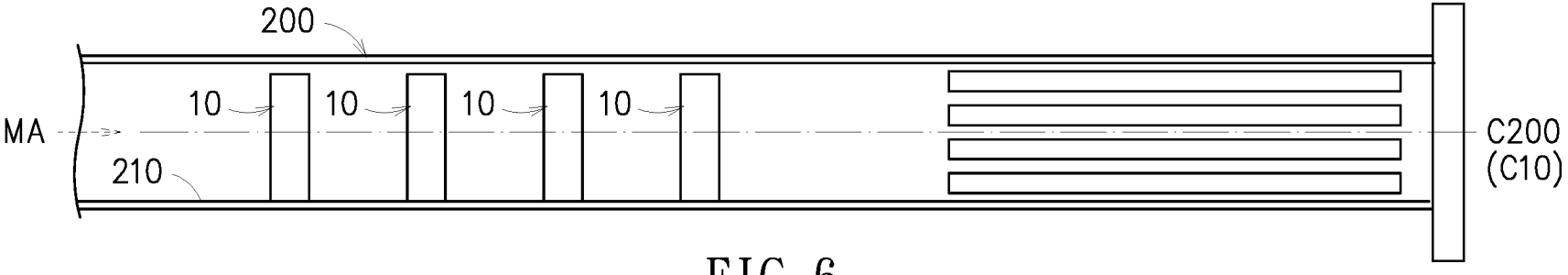
FIG. 6 to FIG. 8 show schematically three different setup styles of the porous element in accordance with this disclosure.
Figure 7:
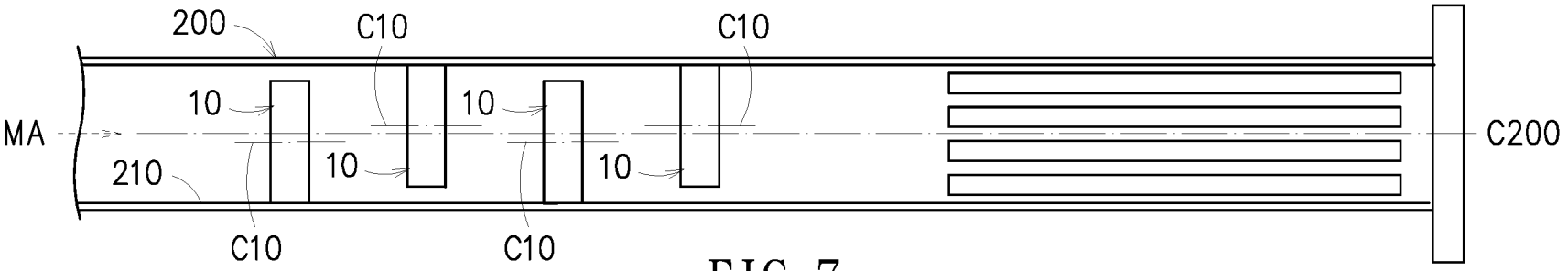
Figure 8:
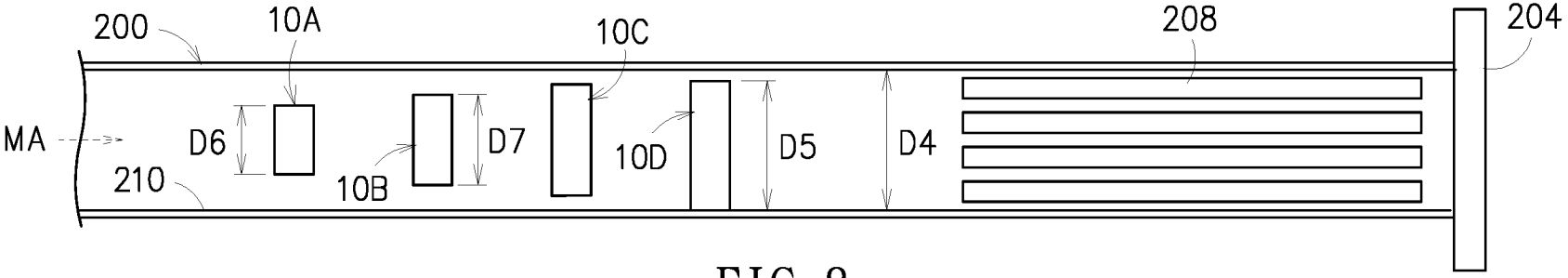

Referring to FIG. 6 to FIG. 8, different setup styles of the porous elements 10 are disclosed. In FIG. 6, four porous elements 10 are disposed inside the radiant tube 200 in an equal-spaced manner. These four porous elements 10 have the same sizes, and the corresponding axes C10 are coaxial with the axis C200 of the radiant tube 200. The outer periphery of each of porous elements 10 is completely contacted with the inner wall 210 of the radiant tube 200. In FIG. 6, the travel direction of the smoke MA is indicated by the arrowed dashed lines.

In FIG. 7, four porous elements 10 are disposed inside the radiant tube 200 in an equal-spaced but up-and-down manner. These four porous elements 10 have their own axes C10 to deviate in an up-and-down manner from the axis C200 of the radiant tube 200. The outer periphery of each of porous elements 10 is partly contacted with the inner wall 210 of the radiant tube 200. The porous element 10 of FIG. 7 is slightly smaller that the porous element 10 of FIG. 6. In FIG. 7, the travel direction of the smoke MA is indicated by the arrowed dashed lines.

In FIG. 8, four different-sized porous elements 10 are disposed inside the radiant tube 200 in an equal-spaced manner, and the travel direction of the smoke MA is indicated by the arrowed dashed lines. Among these four porous elements 10A, 10B, 10C, 10D, the porous element 10A facing the smoke MA has the smallest size, while the porous element 10D close to the outlet 204A has the largest size. Namely, the size of the porous element is increased orderly from left to the right; i.e., along the direction of the smoke MA. An outer periphery of each of the porous elements 10A, 10B, 10C, 10D is partly contacted with the inner wall 210 of the radiant tube 200.

In this embodiment, a ratio of the outer diameter D5 of the largest porous element 10D to the inner diameter D4 of the radiant tube 200, D5/D4, is within 0.82~0.93. A ratio of the outer diameter D6 of the smallest porous element 10A to the outer diameter D5 of the largest porous element 10D, D6/D5, is within 0.33~0.37. A ratio of the outer diameters of two neighboring porous elements is within 0.63~0.78. For example, a ratio of the outer diameter D6 of the porous element 10A to the outer diameter D7 of the porous element 10B, D6/D7, is within 0.63~0.78.

Figure 9:
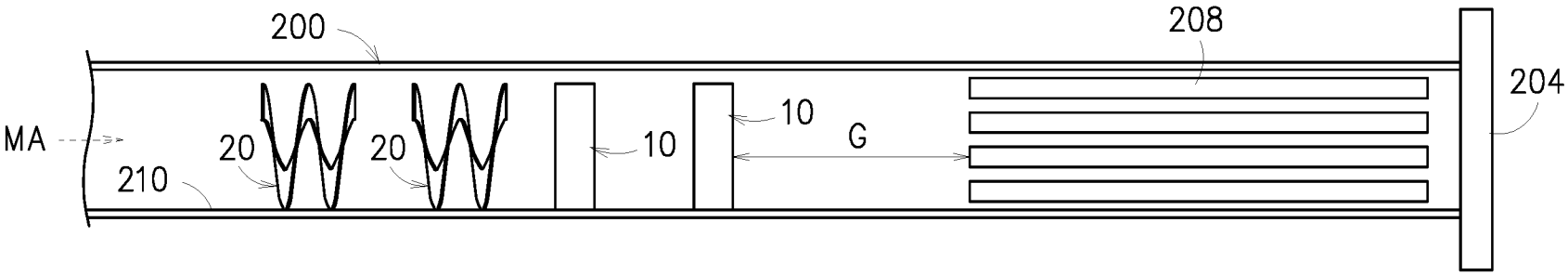
FIG. 9 to FIG. 10 show schematically three different setup styles of the porous element and spiral element in accordance with this disclosure.
Figure 10:
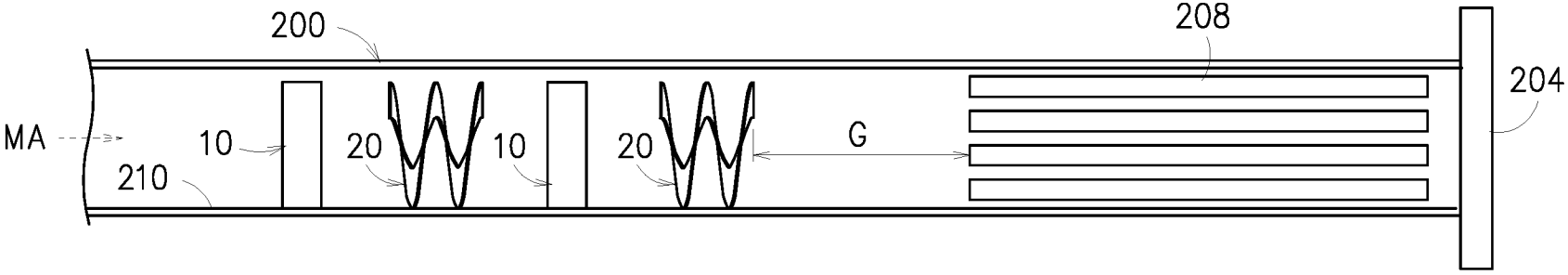

Referring to FIG. 9 and FIG. 10, different setup styles of the porous elements 10 and the spiral element 20 in accordance with this disclosure are schematically shown.

FIG. 9 shows that the radiant tube 200 is furnished thereinside with two porous elements 10 adjacent to each other and two spiral elements 20 also adjacent to each other. The porous element 10 the most close to the outlet 204 is spaced from the reheater 208 by a distance G.

FIG. 10 shows that the radiant tube 200 is furnished thereinside with two porous elements 10 and two spiral elements 20. These two porous elements 10 and these two spiral elements 20 are interspersed settings. The spiral element 20 the most close to the outlet 204 is spaced from the reheater 208 by a distance G.

In the embodiments of FIG. 9 and FIG. 10, an outer periphery of each of the porous elements 10 and the spiral elements 20 is partly adhered to the inner wall 210 of the radiant tube 200.

According to the setup styles illustrated from FIG. 6 to FIG. 10, numbers, relative positions and dimensions of the porous elements 10 and the spiral elements 20 can be determined according to practical requirements.

Figure 11:
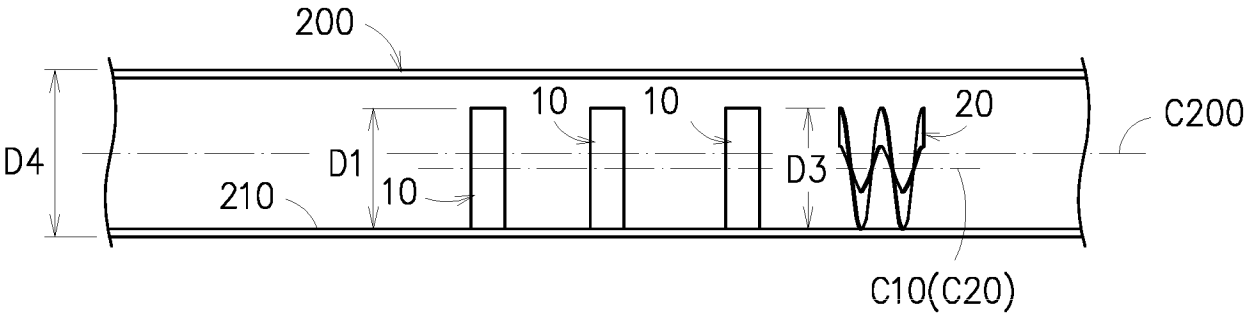
FIG. 11 to FIG. 13 show schematically three different relative position relationships of the porous element, the spiral element and the radiant tube.
Figure 12:
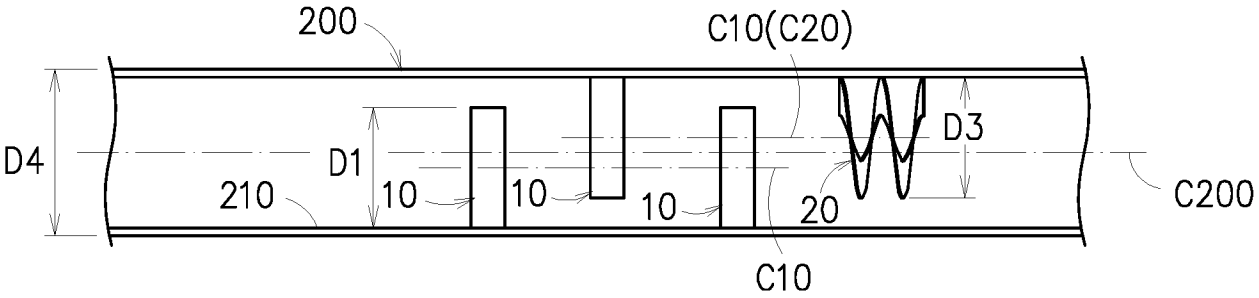
Figure 13:
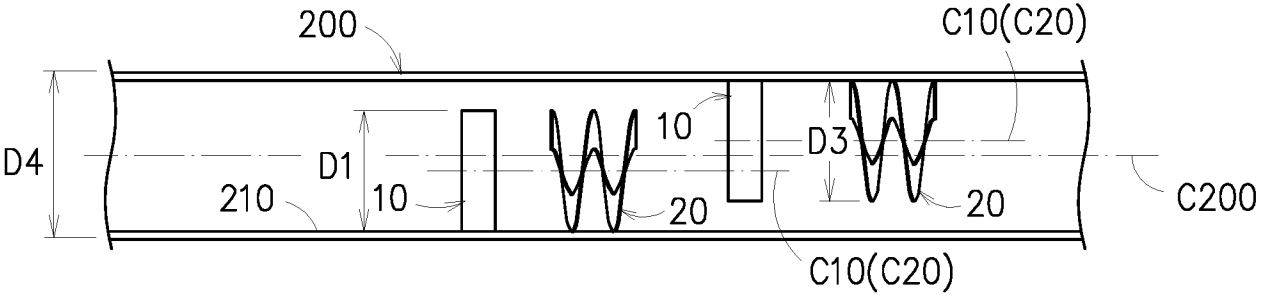

Referring to FIG. 11 to FIG. 13, three different types of the relative position relationships of the porous elements 10, the spiral elements and the radiant tube 200 are schematically illustrated.

In FIG. 11, the axes C10 of three porous elements 10 and the axis C20 of the spiral element 20 are overlapped, and all the axes C10, C20 of the porous elements 10 and the spiral element 20 are deviated from the axis C200 of the radiant tube 200.

In FIG. 12, the axis C10 of the middle porous element 10 and the axis C20 of the spiral element 20 are overlapped, the axes C10 of two lateral porous elements 10 are deviated from the axis C20 of the spiral element 20, and all the axes C10, C20 of the porous elements 10 and the spiral element 20 are deviated from the axis C200 of the radiant tube 200.

In FIG. 13, two porous elements 10 and two spiral element 20 are inserted inside the radiant tube 200. An axis C10 of the left-side porous element 10 and the axis C20 of the spiral element 20 are overlapped, and the axis C10 of the left-side porous element 10 and the axis C20 of the spiral element 20 are also overlapped, and the axes C10 of all the porous elements 10 and the axis C20 of the spiral element 20 are deviated from the axis C200 of the radiant tube 200.

From FIG. 11 to FIG. 13, it shall be understood that the sizes of the porous element 1 and the spiral element 20 and the relative positions with respect to the radiant tube 200 can be varied according to practical needs, and the sizes of the porous element 10 and the spiral element 20 can be identical or different to each other.

Regarding the performance this disclosure can achieve, following simulations and testing can obtain the necessary evidences.

Figure 14:
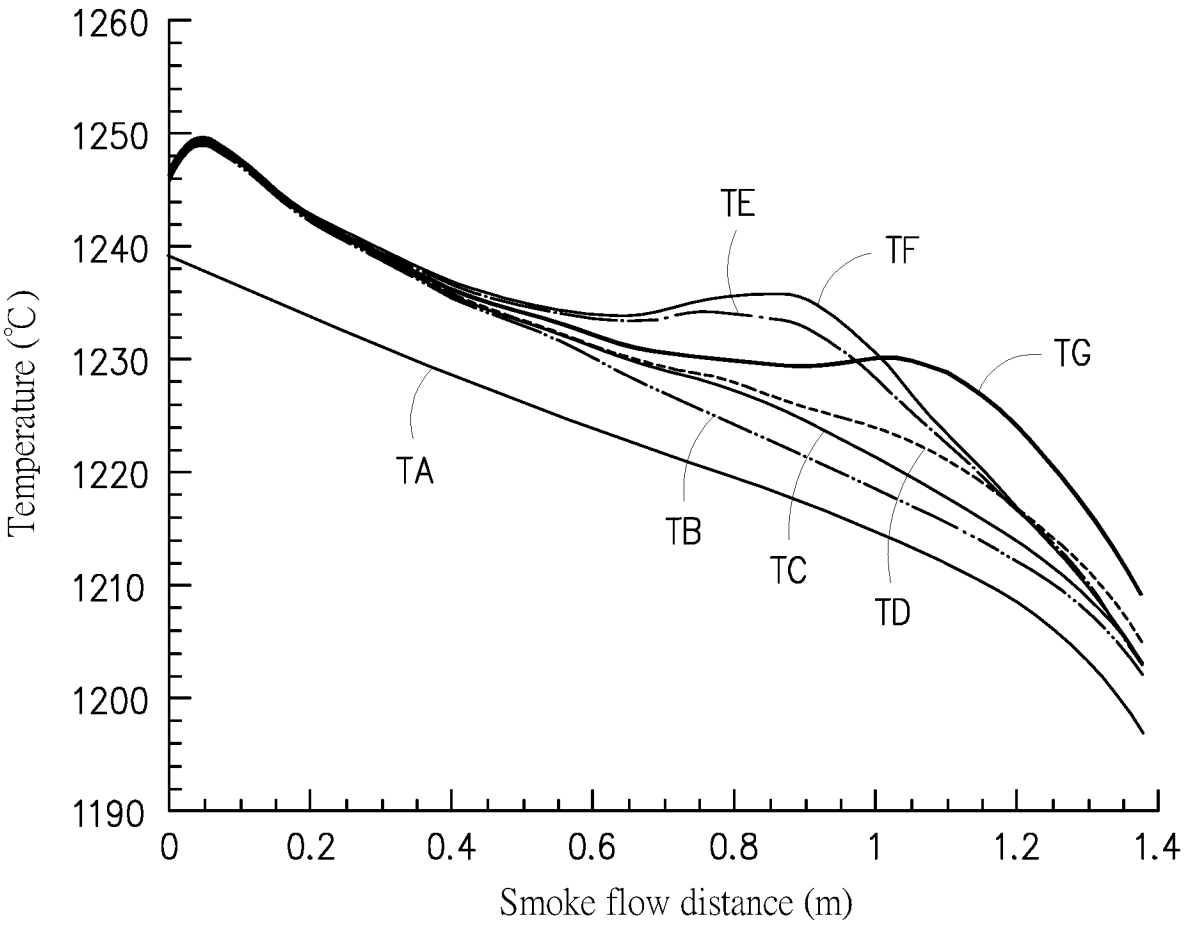
FIG. 14 shows schematically simulated temperature distributions at different dispositions of plug-ins.

Refer to FIG. 14 and FIG. 15A~15G. FIG. 14 shows schematically the simulated temperature distributions (tube-all temperature) with respect to the smoke flow distance. In FIG. 14, measurement at two fixed points separated by 1.4 m upon a smoke MA in the radiant tube 200 are recorded, in which label "0" at the horizontal axis stands for a fixed point facing the smoke MA, and label "1.4" at the horizontal axis stands for another fixed point down streaming the smoke MA at a point separated from the "0" point by 1.4 m. In FIG. 14, 7 temperature curves TA~TG are corresponding to 7 different-structured radiant tubes 200 corresponding to FIG. 15A~15G.

Figure 15A:
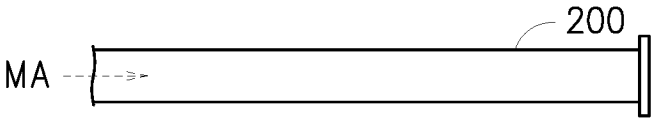
FIG. 15A to FIG. 15G show schematically different radiant tubes with or without different numbers of the porous elements and/or the spiral elements.
Figure 15B:
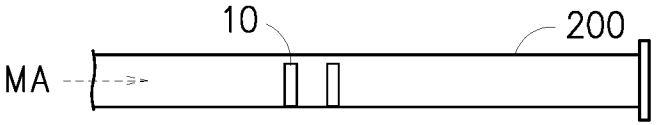
Figure 15C:
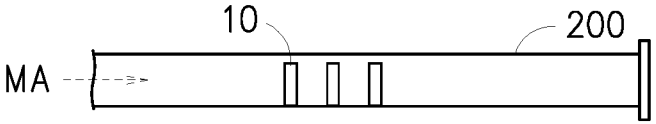
Figure 15D:
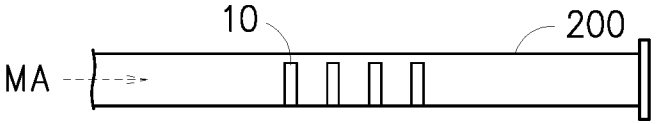
Figure 15E:
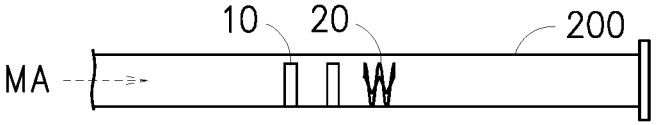
Figure 15F:
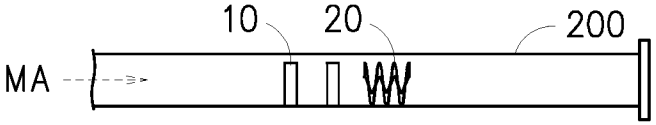
Figure 15G:
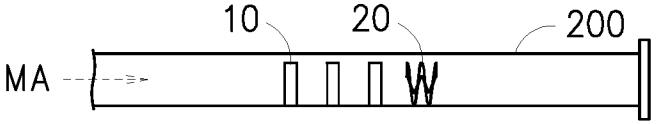

In FIG. 14, temperature curve TA demonstrates the simulation result of the radiant tube 200 of FIG. 15A, where no energy-saving is furnished thereinside; temperature curve TB demonstrates the simulation result of the radiant tube 200 of FIG. 15B, where two porous elements 10 are furnished thereinside; temperature curve TC demonstrates the simulation result of the radiant tube 200 of FIG. 15C, where three porous elements 10 are furnished thereinside; temperature curve TD demonstrates the simulation result of the radiant tube 200 of FIG. 15D, where four porous elements 10 are furnished thereinside; temperature curve TE demonstrates the simulation result of the radiant tube 200 of FIG. 15E, where two porous elements 10 and a spiral element 20 having two pitched spirals are furnished thereinside; temperature curve TF demonstrates the simulation result of the radiant tube 200 of FIG. 15F, where two porous elements 10 and a spiral element 20 having three pitched spirals are furnished thereinside; and, temperature curve TG demonstrates the simulation result of the radiant tube 200 of FIG. 15G, where three porous elements 10 and a spiral element 20 having two pitched spirals are furnished thereinside.

FIG. 14 shows, in comparison to temperature curve TA, temperature curves TB~TG all demonstrate that the tube-wall temperature of each of the radiant tubes 200 can be increased at least by 5~20° C. In particular, temperature curves TE, TF, TG prove that the inclusion of both the porous elements 10 and the spiral element 20 would provide better performance in increasing the tube-wall temperature than the inclusion of only the porous elements 10, such as in temperature curves TB, TC, TD.

Referring to the following table 1, heat flux of the radiant tube corresponding to the simulated situations (FIG. 15A~15G) are listed. Table 1 shows that, in comparison with FIG. 15A, FIG. 15B~FIG. 15G all show that the tube-wall heat flux of the radiant tube 200 can be increased by at least 700 W/m$^2$. Especially, in FIG. 15E, FIG. 15F, FIG. 15G who own both the porous elements 10 and the spiral element 20, the improvement at the heat flux is superior to those applications having the porous elements 10 only (FIG. 15B, FIG. 15C, FIG. 15D).

TABLE 1

| Simulated situation | Heat flux (W/m$^2$) | Increase percentage (%) w.r.t. Bare tube |
|---|---|---|
| FIG. 15A | 8358 | — |
| FIG. 15B | 9067 | 8.5 |
| FIG. 15C | 9339 | 11.7 |
| FIG. 15D | 9563 | 14.4 |
| FIG. 15E | 10103 | 20.9 |
| FIG. 15F | 10296 | 23.2 |
| FIG. 15G | 10251 | 22.6 |

Figure 16:
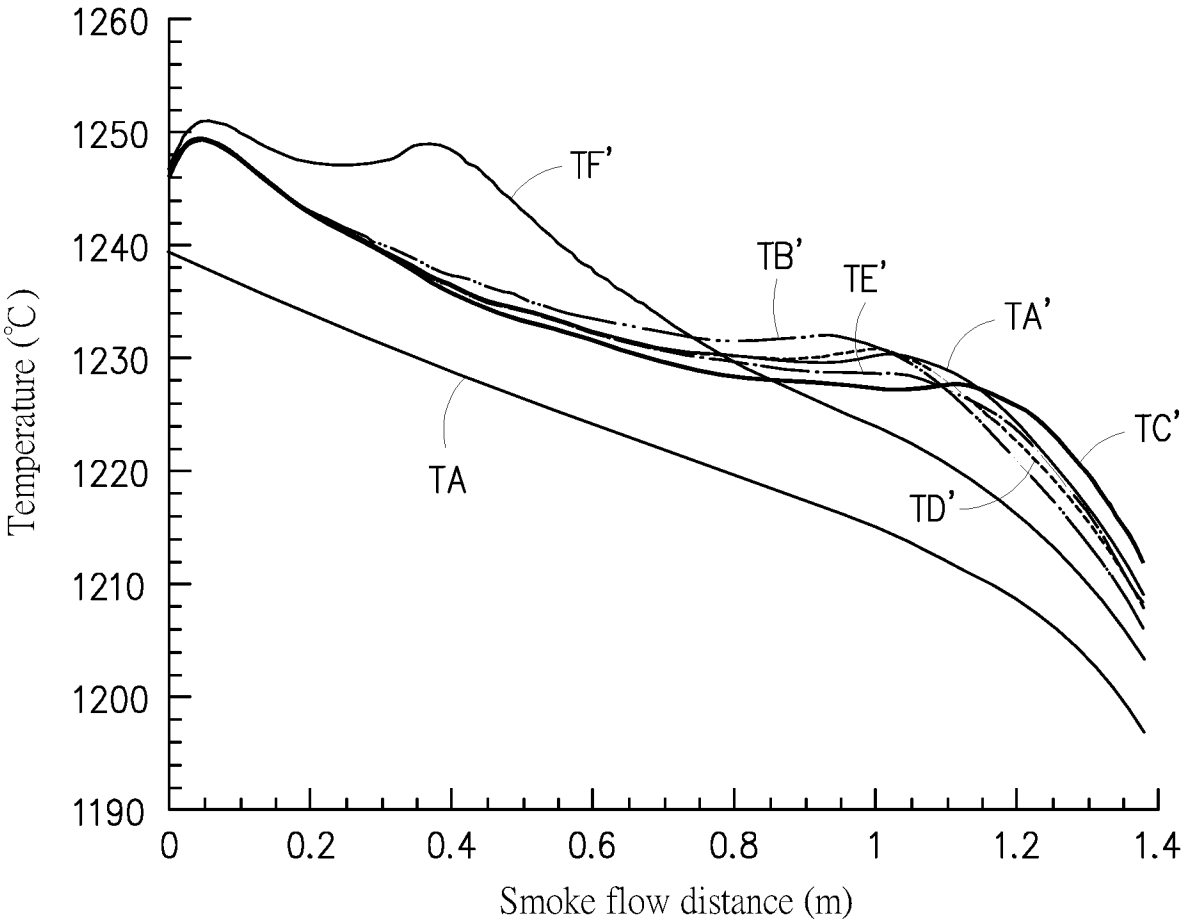
FIG. 16 shows schematically simulated temperature distributions of the tube-wall temperature with respect to the smoke flow distances for situations with different spacing of the porous elements inside the radiant tube and different pitches of the spiral elements.

Refer to FIGS. 16 and 17A~17F, where FIG. 16 shows schematically the simulated temperature distributions (tube-wall temperature) with respect to the smoke flow distance. In FIG. 16, measurement at two fixed points separated by 1.4 m upon a smoke MA in the radiant tube 200 are recorded, in which label "0" at the horizontal axis stands for a fixed point facing the smoke MA, and label "1.4" at the horizontal axis stands for another fixed point down streaming the smoke MA at a point separated from the "0" point by 1.4 m. In FIG. 16, 6 temperature curves TA'~TF' are corresponding to 6 different-structured radiant tubes 200 corresponding to FIG. 17A~17F.

Figure 17A:
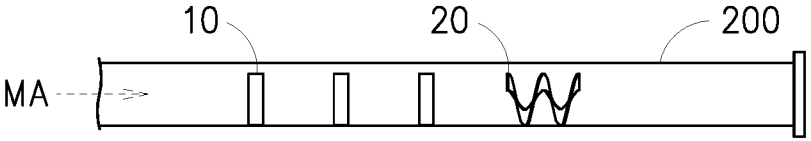
FIG. 17A to FIG. 17F show schematically different radiant tubes with different spacing of the porous elements and different pitches of the spiral elements.
Figure 17B:
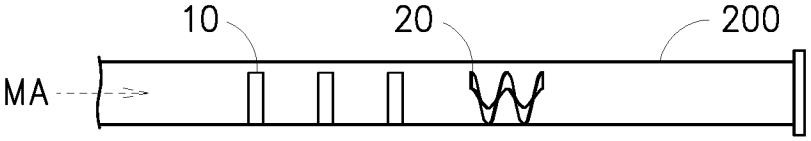
Figure 17C:
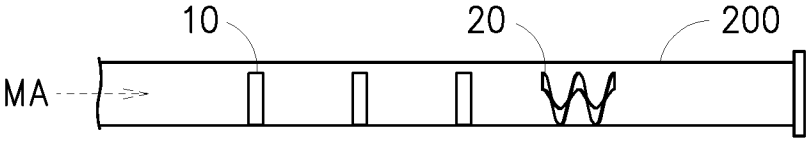
Figure 17D:
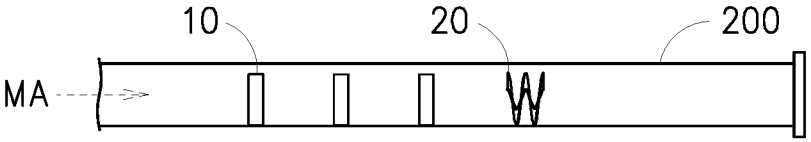
Figure 17E:
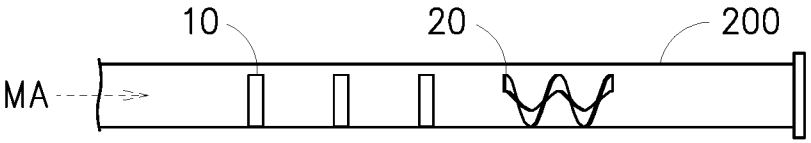
Figure 17F:
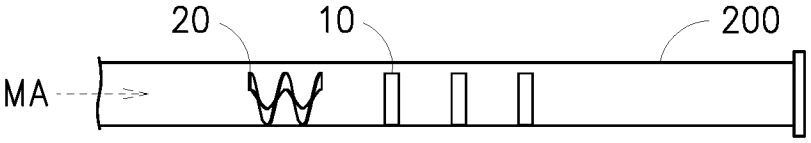

FIG. 17A~FIG. 17C are corresponding to the radiant tubes 200 having spacing S1 (as shown in FIG. 1) of the porous elements 10 to be 200 mm, 150 mm, 250 mm, and the pitch P1 (as shown in FIG. 2A) of the spiral element 20 to be all 100 mm. FIG. 17D and FIG. 17E are corresponding to the radiant tubes 200 having spacing S1 (as shown in FIG. 1) of the porous elements 10 to be both 200 mm, and the pitch P1 (as shown in FIG. 2A) of the spiral element 20 to be 50 mm and 150 mm. FIG. 17F is corresponding to the radiant tube 200 having spacing S1 (as shown in FIG. 1) of the porous elements 10 to be 150 mm, and the pitch P1 (as shown in FIG. 2A) of the spiral element 20 to be 100 mm.

FIG. 16 shows, in comparison to temperature curve TA of FIG. 15A, temperature curves TA'~TF' all demonstrate that the tube-wall temperature of each of the radiant tubes 200 can be increased at least by 5~20° C.

Referring to the following Table 2, heat flux of the radiant tube corresponding to the simulated situations (FIG. 15A~15G) are listed. Table 2 shows that, in comparison with FIG. 15A, FIG. 17A~FIG. 17F with different spacing of the porous elements and different pitches of the spiral element all show that the tube-wall heat flux of the radiant tube 200 can be increased by at least 1750 W/m$^2$; i.e., by 21~22.9%.

TABLE 2

| Simulated situation | Heat flux (W/m$^2$) | Increase percentage (%) w.r.t. Bare tube |
|---|---|---|
| FIG. 17A | 10251 | 22.6 |
| FIG. 17B | 10239 | 22.5 |
| FIG. 17C | 10193 | 22.0 |
| FIG. 17D | 10115 | 21.0 |
| FIG. 17E | 10183 | 21.8 |
| FIG. 17F | 10269 | 22.9 |

Figure 18:
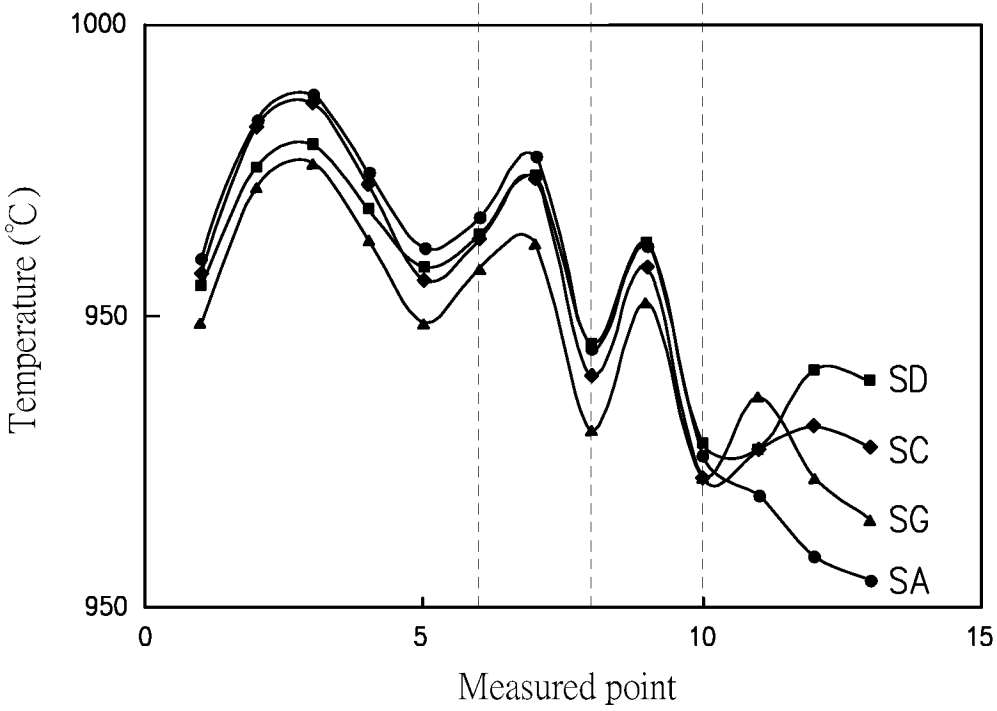
FIG. 18 shows schematically the tube-wall temperature distribution of the radiant tube in the field test.

Referring to FIG. 18, the tube-wall temperature distribution of the radiant tube in the field test is schematically shown. In FIG. 18, 4 temperature curves SA, SC, SD, SG are corresponding to FIG. 15A, 15C, 15D, 15G, respectively, for different types of the radiant tubes 200.

In FIG. 18, the horizontal axis stands for measured points 10~15, and it is implied that the radiant tube 200 is furnished thereinside with the porous elements 10 and/or spiral element 20. Under a condition of having a furnace temperature of 900° ° C., in comparison to temperature curve SA, temperature curves SC, SD, SG all show that the tube-wall temperature of the radiant tube 200 can be increased by at least 5~35° C. Namely, it is proved that the heat transfer performance from the tube wall of the radiant tube 200 to the metallic workpiece can be increased.

Referring to the following Table 3, different test situations are corresponding to FIG. 15A, 15C, 15D, 15G for 4 types of the radiant tube 200. The oxidation catalyst is used for surface coating, with a chemical formula $Cu_{1-x}Ce_xO_y$; in which x is 0.1 to 0.9, y is corresponding to the valence number of Cu or Ce, the oxidation catalyst has middle holes and mega holes, the middle hole has a size within 10 nm to 50 nm, and the mega hole has a size within 100 nm to 400 nm.

TABLE 3

| Test situation | Cumulative NG usage (Nm$^3$/h) | Exhaust temperature (° C.) | Energy-saving percentage (%) |
|---|---|---|---|
| Bare tube | 12.6 | 574.2 | 0.0 |
| 3 porous elements | 12.2 | 559.9 | 3.2 |
| 4 porous elements | 11.8 | 564.8 | 6.3 |
| 3 porous elements + a spiral element | 11.3 | 531.8 | 10.3 |

Regarding the calculations of energy-saving percentage, following equation can be:

$$\delta(\%) = \frac{\eta_s - \eta_b}{\eta_s} \times 100$$

in which, δ is the energy-saving percentage (%);

ηs is the fuel usage without plug-in (m$^3$/h);

ηb is the fuel usage with plug-in (m$^3$/h).

In the situation of maintaining a furnace temperature of 900° C., have the Cumulative NG usage to evaluate the energy-saving percentage upon FIG. 15A, 15C, 15D, 15G. Table 3 tells that, in comparison to the bare tube (FIG. 15A), FIG. 15C, 15D, 15G all have better energy-saving performance. In particular, in FIG. 15G, the radiant tube 200 is furnished thereinside with 3 porous elements 10 and a spiral element 20 having two pitched spirals can provide an improvement up to 10.3%.

Referring to Table 4, in the situation of maintaining a furnace temperature of 900° C., have the Cumulative NG usage to evaluate the effect of the surface coating (catalyst) on the energy-saving percentage upon FIG. 15G. It shows that the catalyst coating can provide better energy-saving performance by 10.3%.

TABLE 4

| Test situation | Exhaust temperature (° C.) | Energy-saving percentage (%) |
|---|---|---|
| 3 porous elements + 1 spiral element (w/o catalyst) | 536.5 | 8.8 |
| 3 porous elements + 1 spiral element (w. catalyst) | 531.8 | 10.3 |

In summary, the energy-saving assembly for indirect heating systems provided in this disclosure utilizes the holes of the porous elements for heat storage, heat conduction and flow diversion, and the coil structure of the spiral element for diversion, heat conduction and spoiling the flow, such that the smoke energy can be transferred to the tube wall of the radiant tube for increasing the tube-wall temperature. Simultaneously, the temperature difference between the carrier and the tube wall would increase the flow disturbance to promote the central high-temperature to flow to the tube wall. Further, the porous elements and the spiral element can be coated with special oxidation catalyst for enduring the high temperatures and catalyzing the unburned $CH_4$ in the smoke to dissipate the heat.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. An energy-saving assembly for indirect heating systems, comprising:

a plurality of porous elements, each of the plurality of porous elements having a porous carrier, the porous carrier having a plurality of holes penetrating individually the porous carrier, an axis of the porous carrier parallel to a radiant tube being separately or close to each other disposed in the radiant tube of one of the indirect heating systems, an outer periphery of one of the plurality of porous elements and an inner wall of the radiant tube being at least partly adhered to each other; and a plurality of spiral elements, each of the plurality of spiral elements having a spiral carrier, the spiral carrier being a coil structure having a plurality of pitched spirals surrounding an axis, each of the plurality of spiral elements being separately or close to each other disposed in the radiant tube by being parallel to the axis of the radiant tube, an outer periphery of each of the plurality of spiral elements and the inner wall of the radiant tube being at least partly adhered to each other, each of the plurality of porous elements having an outer diameter D1, each of the plurality of spiral elements having an outer diameter D3, D1/D3 being within 0.9~1.0.

2. The energy-saving assembly for indirect heating systems of claim 1, wherein the plurality of porous elements and the plurality of spiral elements are interspersed set in the radiant tube with equal or unequal number.

3. The energy-saving assembly for indirect heating systems of claim 1, wherein the porous carrier is cylindrical, the porous carrier has an axis parallel to another axis of the radiant tube and is disposed in the radiant tube, and the axis of the porous carrier and the another axis of the radiant tube are overlapped or misaligned.

4. The energy-saving assembly for indirect heating systems of claim 1, wherein each of the plurality of porous elements has an outer diameter D1, the radiant tube has an inner diameter D4, and a ratio of D1/D4 is within 0.82~0.93; wherein the spiral element has an outer diameter D3, the radiant tube has an inner diameter D4, and D3/D4 is within 0.82~0.93.

5. The energy-saving assembly for indirect heating systems of claim 1, wherein the porous carrier is made of a material having a withstandable temperature within 700~1,220° C.

6. The energy-saving assembly for indirect heating systems of claim 1, wherein each of the plurality of porous elements has 25~50 holes per square inch of cross section.

7. The energy-saving assembly for indirect heating systems of claim 1, wherein each of the plurality of porous elements has a first thickness in a direction parallel to the axis of the radiant tube, and the first thickness being within 50 mm to 100 mm.

8. The energy-saving assembly for indirect heating systems of claim 1, wherein the axis of each of the plurality of spiral elements and the axis of the radiant tube are overlapped or misaligned.

9. The energy-saving assembly for indirect heating systems of claim 1, wherein each of the plurality of spiral elements has an inner diameter D2 and an outer diameter D3, and D2/D3 is within 0.33~0.37.

10. The energy-saving assembly for indirect heating systems of claim 1, wherein each of the plurality of spiral elements has a plurality of pitched spirals, each of the plurality of pitched spirals has an axial length P1, each of the plurality of spiral elements has an axial length L1 parallel to the axis, and L1/P1 is within 1.5~2.

11. The energy-saving assembly for indirect heating systems of claim 1, wherein each of the plurality of spiral elements has a second thickness, and the second thickness is within 5 mm to 10 mm.

12. The energy-saving assembly for indirect heating systems of claim 1, wherein the spiral carrier is made of an alloy or a ceramic.

13. The energy-saving assembly for indirect heating systems of claim 1, wherein the porous carrier is coated with an oxidation catalyst, the oxidation catalyst chemical formula is $Cu_{1-x}M_xO_y$, in which M is Ce or Mn, x is 0.1 to 0.9, y is a valence number corresponding to Cu or M, the oxidation catalyst has a middle hole and a mega hole, the middle hole has a size within 10 nm to 50 nm, and the mega hole has a size within 100 nm to 400 nm.

14. The energy-saving assembly for indirect heating systems of claim 1, wherein the installation scope is located in a straight tube of the radiant tube by close to an outlet, the installation scope has an axial length L2 parallel to the axis of the radiant tube, the straight tube has an axial length L3 to the axis of the radiant tube, and L2/L3 is within 0.45~0.51.

15. The energy-saving assembly for indirect heating systems of claim 1, wherein the plurality of porous elements have different outer diameters, the biggest outer diameter is D5, an inner diameter of the radiant tube is D4, D5/D4 is within 0.82~0.93; the smallest outer diameter is D6, D6/D5 is within 0.33~0.37; and, a ratio of the outer diameters of two neighboring said porous elements is within 0.63~0.78.

16. An energy-saving assembly for indirect heating systems, comprising:

a plurality of porous elements, separately arranged in a radiant tube of an indirect heating system by being parallel to an axis of a radiant tube of indirect heating system, each of the plurality of porous elements having a porous carrier, the porous carrier having a plurality of holes penetrating through the porous carrier, the porous carrier being coated by an oxidation catalyst having a chemical formula of $Cu_{1-x}M_xO_y$, the M being a Ce or an Mn, the x being within 0.1 to 0.9, the y being a valence number corresponding to the Cu and the M, the oxidation catalyst having a middle hole and a mega hole, the middle hole having a dimension within 10 nm to 50 nm, the mega hole having a dimension within 100 nm to 400 nm; and a plurality of spiral elements, each of the plurality of spiral elements having a spiral carrier, the spiral carrier being a coil structure having a plurality of pitched spirals surrounding an axis, the spiral carrier being coated by an oxidation catalyst, an outer periphery of each of the plurality of spiral elements and the inner wall of the radiant tube being at least partly adhered to each other, each of the plurality of porous elements having an outer diameter D1, each of the plurality of spiral elements having an outer diameter D3, D1/D3 being within 0.9~1.0.

17. The energy-saving assembly for indirect heating systems of claim 16, wherein the plurality of porous elements and the plurality of spiral elements are interspersed set in the radiant tube with equal or unequal number.

18. The energy-saving assembly for indirect heating systems of claim 16, wherein the porous carrier is cylindrical, the porous carrier has an axis parallel to another axis of the radiant tube and is disposed in the radiant tube, and the axis of the porous carrier and the another axis of the radiant tube are overlapped or misaligned.

19. The energy-saving assembly for indirect heating systems of claim 16, wherein each of the plurality of porous elements has an outer diameter D1, the radiant tube has an inner diameter D4, and a ratio of D1/D4 is within 0.82~0.93; the spiral element has an outer diameter D3, the radiant tube has an inner diameter D4, and D3/D4 is within 0.82~0.93.

20. The energy-saving assembly for indirect heating systems of claim 16, wherein the porous carrier is made of a material having a withstandable temperature within 700~1, 220° C.

21. The energy-saving assembly for indirect heating systems of claim 16, wherein each of the plurality of porous elements has 25~50 holes per square inch of cross section.

22. The energy-saving assembly for indirect heating systems of claim 16, wherein each of the plurality of porous elements has a first thickness in a direction parallel to the axis of the radiant tube, and the first thickness being within 50 mm to 100 mm.

23. The energy-saving assembly for indirect heating systems of claim 16, wherein the axis of each of the plurality of spiral elements and the axis of the radiant tube are overlapped or misaligned.

24. The energy-saving assembly for indirect heating systems of claim 16, wherein each of the plurality of spiral elements has an inner diameter D2 and an outer diameter D3, and D2/D3 is within 0.33~0.37.

25. The energy-saving assembly for indirect heating systems of claim 16, wherein each of the plurality of spiral elements has a plurality of pitched spirals, each of the plurality of pitched spirals has an axial length P1, each of the plurality of spiral elements has an axial length L1 parallel to the axis, and L1/P1 is within 1.5~2.

26. The energy-saving assembly for indirect heating systems of claim 16, wherein each of the plurality of spiral elements has a second thickness, and the second thickness is within 5 mm to 10 mm.

27. The energy-saving assembly for indirect heating systems of claim 16, wherein the spiral carrier is made of an alloy or a ceramic.

28. The energy-saving assembly for indirect heating systems of claim 16, wherein the installation scope is located in a straight tube of the radiant tube by close to an outlet, the installation scope has an axial length L2 parallel to the axis of the radiant tube, the straight tube has an axial length L3 to the axis of the radiant tube, and L2/L3 is within 0.45~0.51.

29. The energy-saving assembly for indirect heating systems of claim 16, wherein the plurality of porous elements have different outer diameters, the biggest outer diameter is D5, an inner diameter of the radiant tube is D4, D5/D4 is within 0.82~0.93; the smallest outer diameter is D6, D6/D5 is within 0.33~0.37; and, a ratio of the outer diameters of two neighboring said porous elements is within 0.63~0.78.

* * * * *